US007182231B1

(12) United States Patent
Greiner

(10) Patent No.: US 7,182,231 B1
(45) Date of Patent: Feb. 27, 2007

(54) GARMENT HANGER

(76) Inventor: Lori Greiner, 1301 Dearborn Pkwy., Suite 402, Chicago, IL (US) 60610

( * ) Notice: Subject to any disclaimer, the term of this patent is extended or adjusted under 35 U.S.C. 154(b) by 418 days.

(21) Appl. No.: 10/821,110

(22) Filed: Apr. 8, 2004

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS 3,412,911 A * 11/1968 Eshelman ..... 223/95
3,741,449 A * 6/1973 MacKenzie ..... 223/91
5,535,927 A * 7/1996 Garrison ..... 223/92
6,264,076 B1 * 7/2001 Stocchiero ..... 223/85
6,772,923 B2 * 8/2004 Olk et al. ..... 223/85
6,811,064 B2 * 11/2004 Salem ..... 223/94
6,863,197 B1 * 3/2005 Dirlam et al. ..... 223/93
6,926,180 B2 * 8/2005 Mainetti ..... 223/85
6,974,057 B1 * 12/2005 Smith ..... 223/85

OTHER PUBLICATIONS

U.S. Appl. No.: 29/202,373, filed Mar. 30, 2004, Title: Garment Hanger, Applicant: Lori Greiner.
U.S. Appl. No. 29/202,374, filed Mar. 30, 2004, Title: Garment Hanger, Applicant: Lori Greiner.
U.S. Appl. No. 29/202,375, filed: Mar. 30, 2004, Title: Garment Hanger, Applicant: Lori Greiner.

* cited by examiner

*Primary Examiner*—Shaun R. Hurley
(74) *Attorney, Agent, or Firm*—Fredrikson & Byron, P.A.

(57) ABSTRACT

A garment hanger that can hold articles as heavy as about 40 pounds yet is very thin so that it takes up minimal closet space. In addition, the shape of the holder reduces creases and dimples formed on the article of clothing and non-slip surfaces help prevent clothes from slipping off the hanger. Also, because of the dimensions of the hanger, the hanger according to the embodiments of the invention can hold a wide range of sizes of articles, from petites to extra large.

41 Claims, 12 Drawing Sheets

GARMENT HANGER

FIELD OF THE INVENTION

The embodiments of the present invention relate generally to a garment hanger.

BACKGROUND OF THE INVENTION

Several types of garment hangers are commonly used for hanging clothes. Common hangers include wire hangers, plastic hangers, wood hangers and padded cloth hangers. Hangers are also varied in size. Each of these types and sizes of hangers have both advantages and disadvantages.

Wire hangers are advantageous because they often do not take up a lot of space in a closet. Likewise, these hangers are often lightweight and do not add significantly to the weight being carried on a closet rack. Wire hangers are also often cheaper to manufacture than many other types of hangers. However, wire hangers are disadvantageous because garments commonly slip off of these hangers. Also, wire hangers are limited in their capacity to carry weight. When too much weight is placed upon a wire hanger, the wire may tend to bend and lose its shape. Another disadvantage of wire hangers is that they often cause creases or dimples on garments hung upon the hanger.

Like wire hangers, plastic hangers are also advantageous in that they are often lightweight and cheaper to manufacture than other hanger types. Plastic hangers are also disadvantageous because they are often limited in their capacity to carry weight. When too much weight is placed upon a plastic hanger, the plastic tends to break. Plastic hangers can also be slippery causing garments to slip off of the hangers. Depending on the size and shape of the hanger, the plastic hanger may also cause dimples and creases on hung garments.

Wood hangers are advantageous because they are often able to carry more weight than other types of hangers. Wooden hangers are less often damaged when heavy coats or multiple garments are placed upon them. However, wooden hangers are disadvantageous because they are often big and bulky and take up a lot of space in a closet. Likewise, wooden hangers are heavier than their plastic and wire counterparts. Also, wooden hangers can be expensive to manufacture.

Thus, there is a need to produce hangers that are less expensive to manufacture, take up less space in a closet, are able to carry larger loads of weight, prevent the creation of creases and dimples on garments and prevent garments from slipping off the hanger onto the floor.

SUMMARY OF THE INVENTION

The present invention provides a garment hanger that is less expensive to manufacture, takes up less space in a closet, is able to carry larger loads of weight, prevents the creation of creases and dimples on garments and prevents garments from slipping off onto the floor.

According to a first aspect of the invention, there is provided a hanger having a support body, a hook and one or more non-slip surfaces. The support body includes a body having a closed top and sidewalls. Exterior surfaces of the sidewalls are separated by a distance ranging from about 0.1 inches to about 0.5 inches. The body is configured as two shoulder bars joined together at a center, each of the two shoulder bars having distal end regions that terminate at distal ends. The hook is coupled to the support body and the one or more non-slip surfaces are positioned on the support body. The support body can support a weight of up to about 40 pounds.

According to a second aspect of the invention, there is provided a garment hanger having a hook and a support body. The support body includes a body having a closed top and sidewalls. Exterior surfaces of the sidewalls are separated at a distance ranging from about 0.1 inches to about 0.5 inches. The body is configured as two shoulder bars joined together at a center, the two shoulder bars each having distal end regions that terminate at distal ends. An article supporting bar is connected to the support body by vertical support bars. The article supporting bar includes an article engaging surface positioned on top of a horizontal support bar. Also included are one or more clamps positioned upon the article supporting bar and one or more non-slip surfaces positioned upon any of the support body, article supporting bar, and one or more clamps. The support body can support a weight of at least 25 pounds.

According to a third aspect of the invention, there is provided a hanger having a support body adapted for suspension from a support. The support body has first and second oppositely directed shoulder bars, the first and second shoulder bars being angularly downwardly directed so as to be suitable for hanging a shouldered garment thereon. The first and second shoulder bars have distal end regions that terminate at distal end regions, the first and second shoulder bars having a thickness ranging from about 0.1 inches to about 0.5 inches. One or more non-slip surfaces may be disposed on the first and second shoulder bars.

DETAILED DESCRIPTION OF THE PREFERRED EMBODIMENTS

The following detailed description should be read with reference to the drawings, in which like elements in different drawings are numbered identically. The drawings depict selected embodiments and are not intended to limit the scope of the invention. It will be understood that embodiments shown in drawings and described above are merely for illustrative purposes, and are not intended to limit scope of the invention as defined in the claims that follow.

Figure 1:
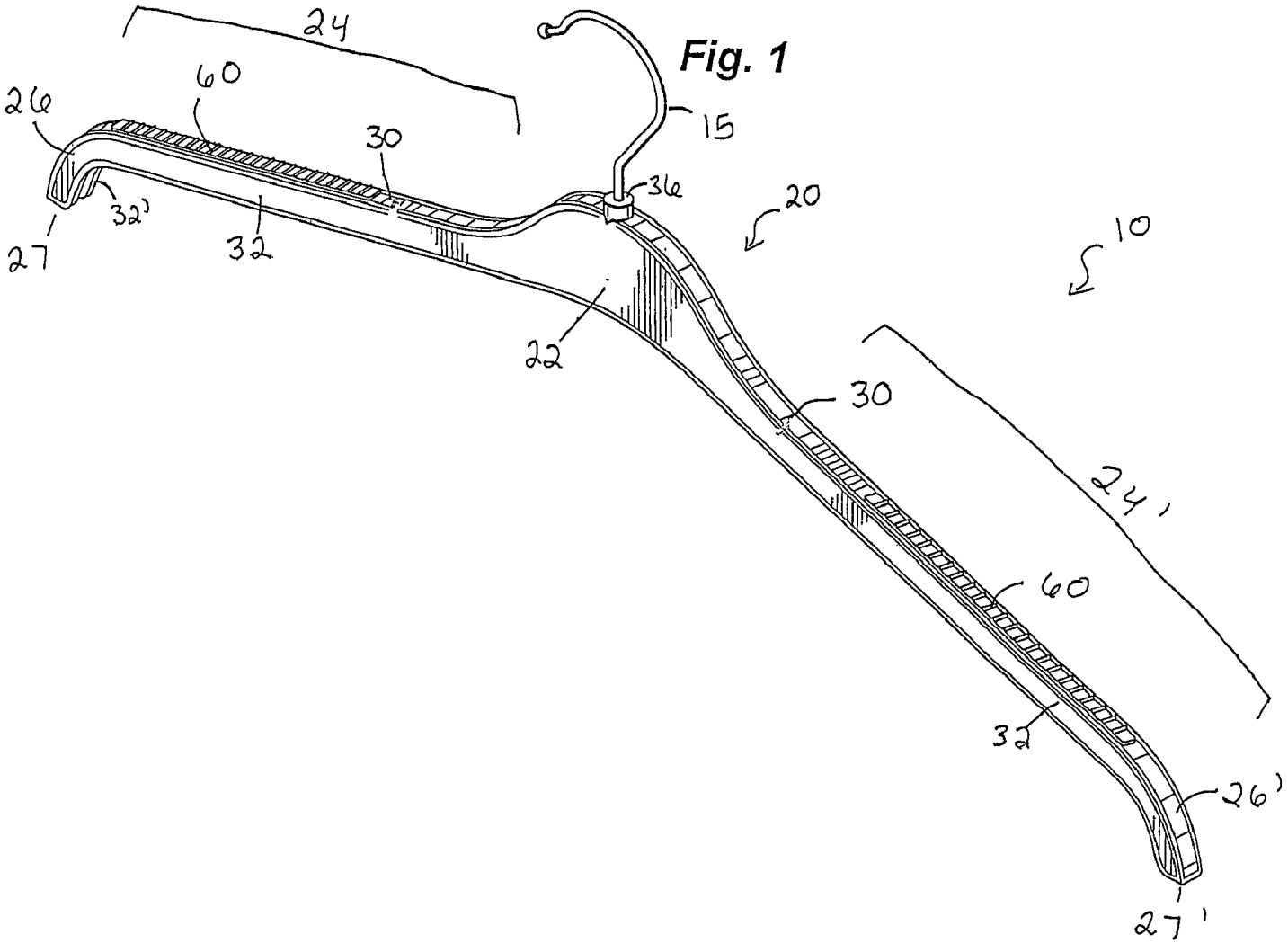
FIG. 1 is a perspective view of a hanger according to a first embodiment of the invention.
Figure 2:
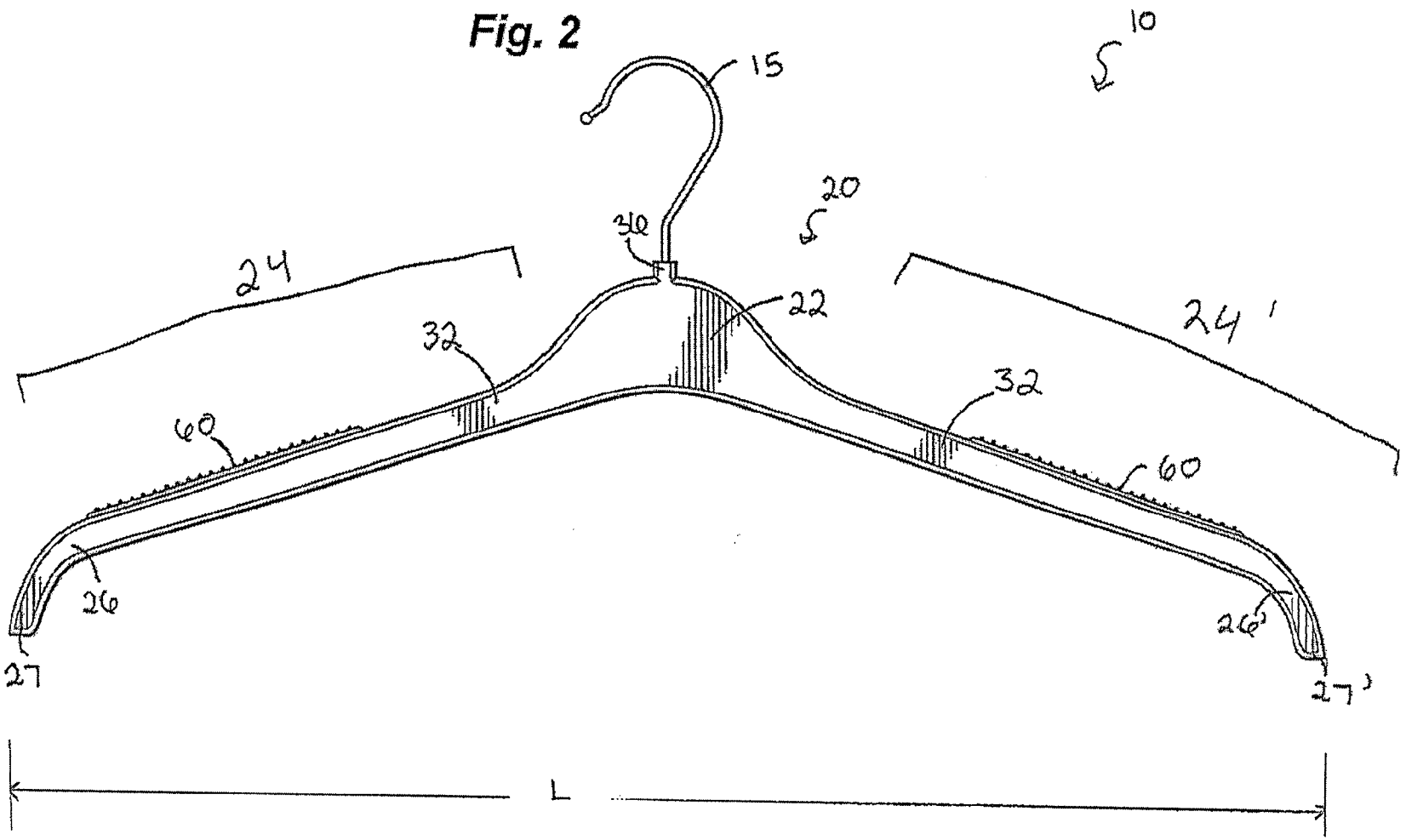
FIG. 2 is a front view of the hanger in FIG. 1.
Figure 3:
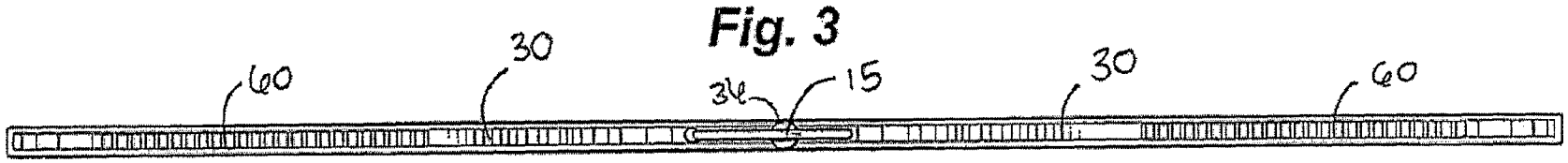
FIG. 3 is a top view of the hanger in FIG. 1.
Figure 4:
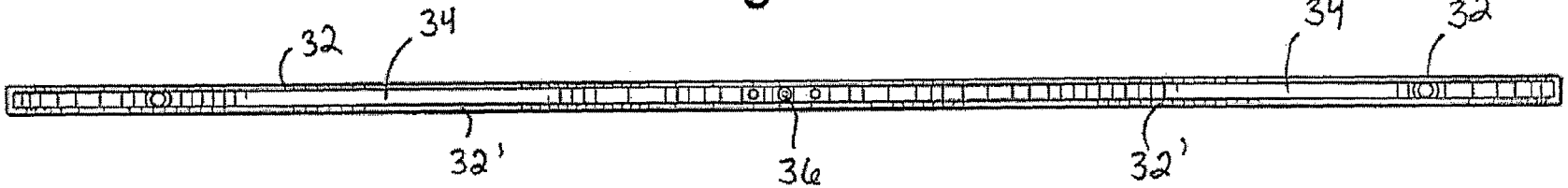
FIG. 4 is a bottom view of the hanger in FIG. 1.
Figure 5:
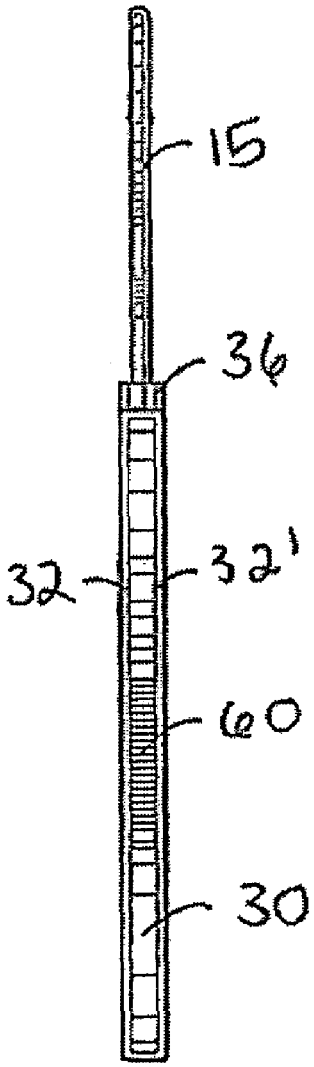
FIG. 5 is a right side view of the hanger in FIG. 1.
Figure 6:
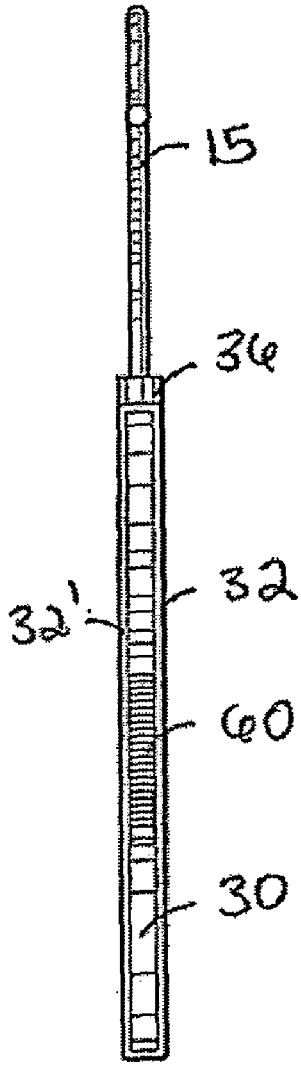
FIG. 6 is a left side view of the hanger in FIG. 1.

A first embodiment of the hanger is shown in FIGS. 1–6. The hanger 10 includes a support body 20 and a hook 15. The hook 15 may or may not be integral to the support body 20. In the illustrated embodiment, the hook 15 is not integral to the support body 20. Rather, the hook 15 is a separate component that is attachable or coupled to the support body 20. The hook 15 is preferably curved so as to engage a clothes rod or the like. The hook 15 can be formed of any suitable material. In preferred embodiments, the hook 15 is formed of a metal material, such as cast steel or a bent steel wire or it may be made of plastic that may or may not be integral with the support body 20.

The support body 20 has a generally V-shape configuration and includes two oppositely directed shoulder bars 24, 24' connected together at a junction or center 22. The shoulder bars 24, 24' extend from the center 22 to distal end regions 26, 26' that are curved and terminate at distal ends 27, 27'. The shoulder bars 24, 24' are preferably angularly downwardly directed from the center 22 to the distal end regions 26, 26' so as to be suitable for hanging a shouldered garment thereon. The distal end regions 26, 26' each have a constant radius of curvature ranging from about 1 inch to about 3 inches. Preferably, the distal end regions 26, 26' each have a constant radius of curvature of about 1.7 inches.

The support body 20 preferably has a height measured from the bottommost point of the distal ends 27, 27' to the topmost point of the center 22 ranging from about 6 inches to about 10 inches. Preferably, it has a height of about 8.1 inches. The support body 20 preferably has a length (L, see FIG. 2) measured from the outermost point of distal end 27 to the outermost point of distal end 27' that may range from about 14 inches to about 22 inches. More preferably, the hanger has a length that may range from about 14 inches to about 20 inches and most preferably, the length L is about 18.125 inches. The support body 20 preferably has a thickness measured from the outermost point of sidewall 32 to the outermost point of sidewall 32' ranging from about 0.1 to about 0.5 inches. Preferably the support body 20 has a thickness measured from the outermost point of sidewall 32 to the outermost point of sidewall 32' of about 0.35 inches. A hanger having a support body with these dimensions easily fits into a closet without taking up too much space.

The support body 20 is preferably made of a synthetic polymer composition material. In preferred embodiments, the support body 20 is made of a molded plastic material, for example polypropylene, polyethylene, polystyrene or acrylonitrile butadiene styrene, commonly know as ABS. Any molded plastic material can be used so long as it is sufficiently strong to carry heavy garments. A hanger made of a molded plastic material is often cheaper to manufacture than many others. Alternatively, the hanger according to the embodiments disclosed herein may be made from wire or wood. The hangers formed according to the preferred embodiments disclosed herein should hold a weight of up to 40 pounds without bending or deforming and at a minimum should hold a weight of at least 25 pounds.

The support body 20 is also preferably a hollow body having a U-shaped cross-section. For example, the support body has a closed top 30, sidewalls 32, 32 and an open bottom 34. A hollow body reduces the weight of the hanger and is nicely suited to the molding process because the top and sidewalls all harden at the same rate as opposed to solid plastic hangers. In addition, much less material is needed compared to solid hangers. Alternatively, the support body 20 may be a solid body having a top 30 and side walls 32.

The support body 20 may also include one or more non-slip surfaces 60. Preferably, non-slip surfaces 60 are provided on the shoulder bars 24, 24', for example on the closed top 30. Providing non-slip surfaces 60 on the shoulder bars help to prevent garments from slipping off of the shoulder bars. The non-slip surfaces can be any material that reduces slippage, e.g. rubber or other elastomeric polymers. Grooves may be also provided on the non-slip surfaces 60 to enhance the non-slip properties of such surface. Preferably, the non-slip surfaces 60 are glued onto the hanger. They may also be placed in a recess formed on the hanger so that a top surface of the non-slip surface is exposed to a garment or they may be molded into the support body. The shape and size of the hanger according to the various embodiments disclosed are able to support a wide range of clothing sizes. For example, the hanger according to the various embodiments can hold women's clothing ranging from petite sizes to extra large sizes. Also, because of the size and shape of the hanger according to the various embodiments disclosed herein, it can hold such a wide range of clothing sizes without causing dimples in the shoulder regions of the article of clothing. In addition, adding non-slip surfaces to the article bearing surface of the hanger helps prevent slippage of the article of clothing.

The hook 15 is preferably located where the shoulder bars 24, 24' join together, i.e., the center 22. In preferred embodiments, the mold of the support body 20 preferably includes an aperture 36 in the center 22 for receiving the hook 15. The hook is retained in place during the molding process as is well known to those of ordinary skill in the art.

Figure 7:
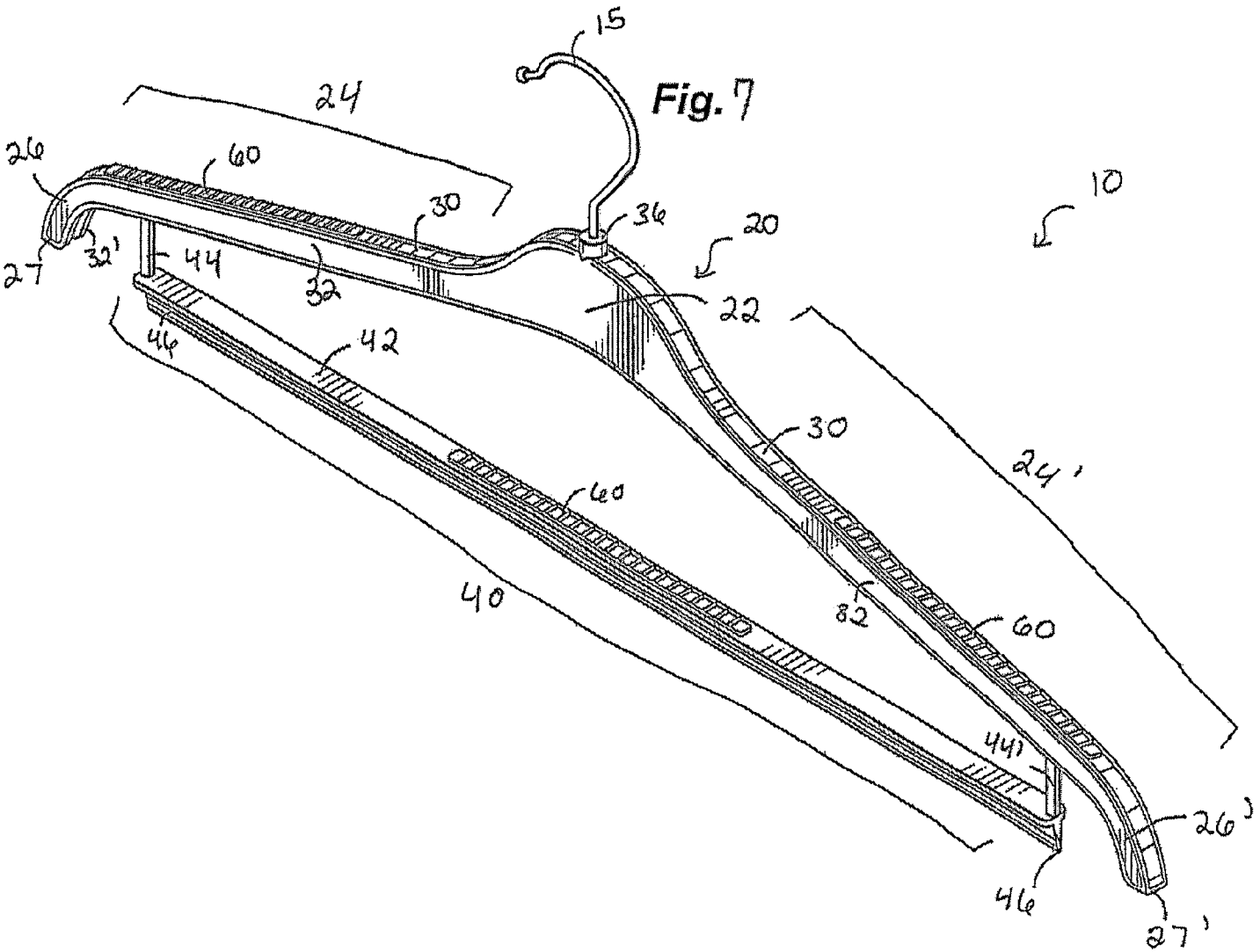
FIG. 7 is a perspective view of a hanger according to a second embodiment of the invention.
Figure 8:
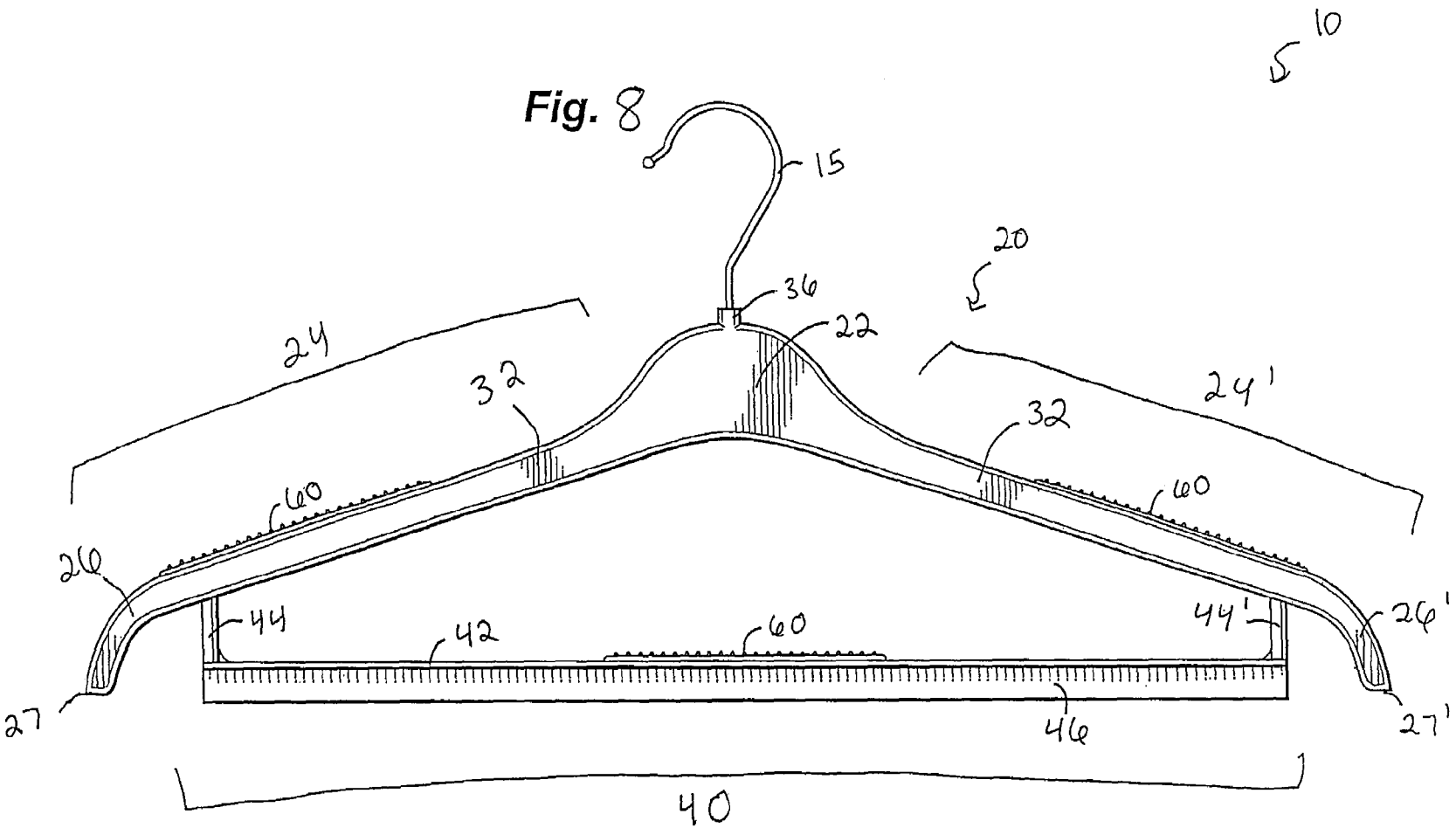
FIG. 8 is a front view of the hanger in FIG. 7.
Figure 9:
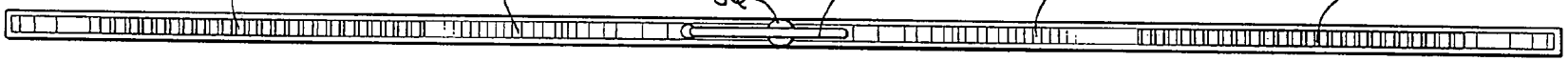
FIG. 9 is a top view of the hanger in FIG. 7.
Figure 10:
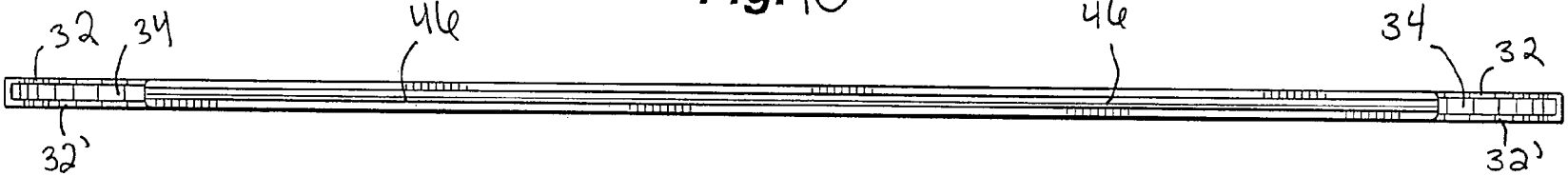
FIG. 10 is a bottom view of the hanger in FIG. 7.
Figure 11:
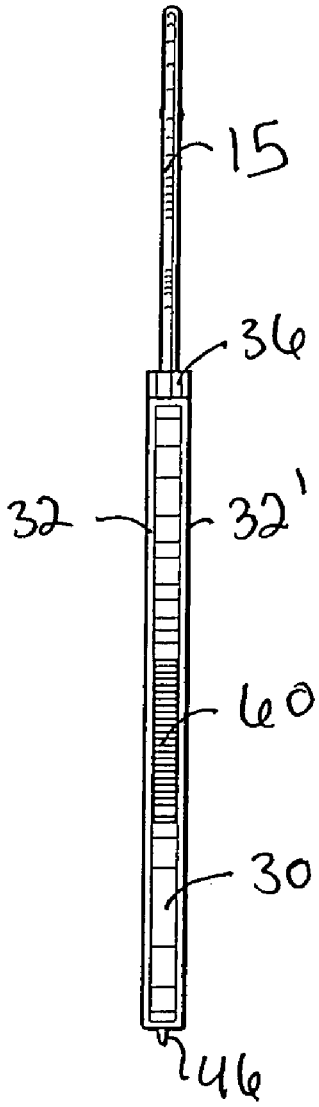
FIG. 11 is a right side view of the hanger in FIG. 7.
Figure 12:
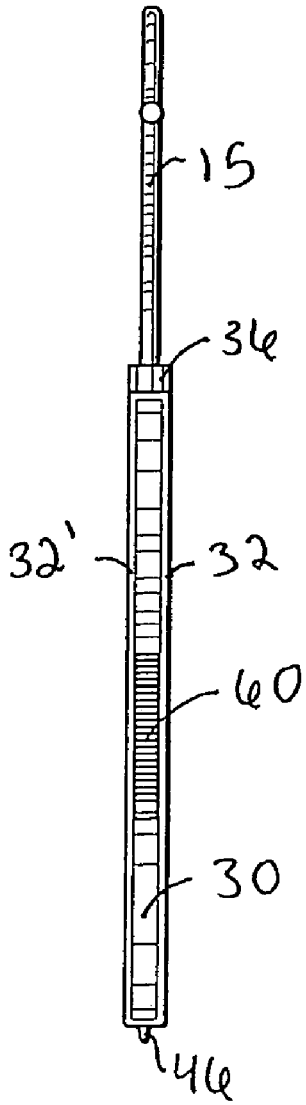
FIG. 12 is a left side view of the hanger in FIG. 7.

A second embodiment of the hanger is shown in FIGS. 7–12. This embodiment includes the elements of the first embodiment and further includes an article bar 40. The article bar 40 is used for hanging garments for example pants, slacks, skirts, sweaters and the like. The article bar 40 preferably extends horizontally and is connected to the shoulder bar 24, 24' at a location where the distal end regions 26, 26' begin by vertical support bars 44,44'.

The article bar 40 preferably includes a flat, article engaging surface 42 positioned on top of a horizontal support bar 46. The flat article engaging surface 42 reduces the creasing of garments hung on the article bar 40. One or more non-slip surfaces 60 may also be provided along the article engaging surface 42 to improve the gripping of garments on the article bar 40. Grooves may also be provided on the non-slip surfaces 60 to enhance its non-slip properties. The article engaging surface 42 may have other shapes than being flat, such as round.

The article engaging surface 42 preferably has a height ranging from about 0.02 inches to about 0.12 inches and, more preferably has a height of about 0.08 inches, a length ranging from about 11 inches to about 22 inches, and, more preferably, a length of about 14.8 inches, and a width ranging from about 0.10 inches to about 0.50 inches, and, more preferably, a width of about 0.35 inches. The horizontal support bar 46 preferably has a height ranging from about 0.10 inches to about 1 inch and, more preferably, a height of about 0.438 inches and a length ranging from about 11 inches to about 22 inches and, more preferably, a length of about 14.8 inches. The horizontal support bar 46 provides the support to article engaging surface 42 so that it does not bend when an article is supported by surface 42. Alternatively, the horizontal support bar may be omitted.

The article bar 40 is preferably fabricated of the same material as the support body 20, for example a molded plastic material such as polypropylene, polyethylene, polystyrene or ABS or wood or wire. In some embodiments, the support body 20, article bar 40, and vertical support bars 44, 44' are fabricated as a single body, for example by injection molding. Again, a molded plastic material is advantageous because it is often cheaper and easier to make. Alternatively, the article bar 40 and vertical support bars 44, 44' are formed separately from the support body 20 and then glued onto the support body 20.

Figure 13:
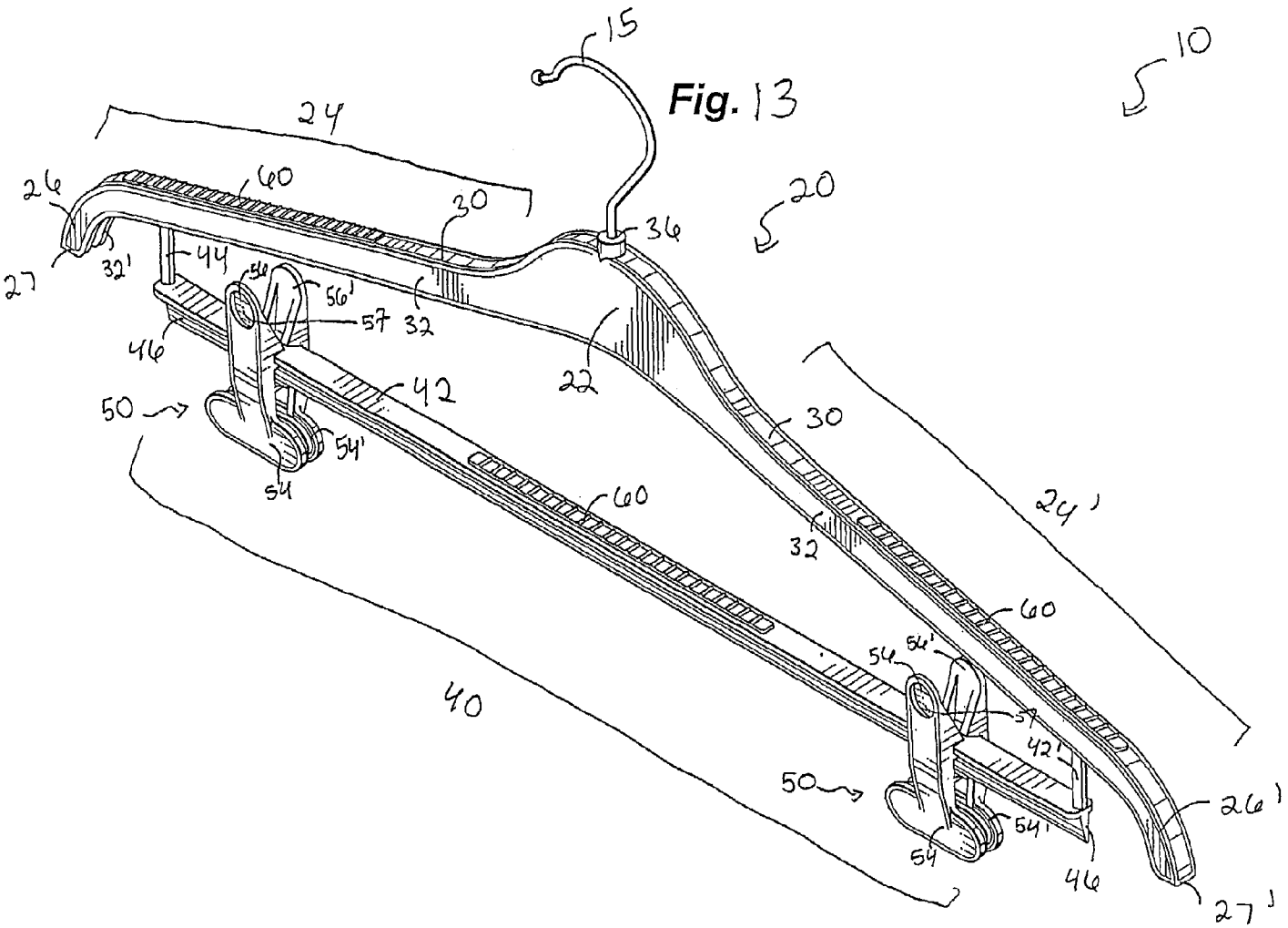
FIG. 13 is a perspective view of a hanger according to a third embodiment of the invention.
Figure 14:
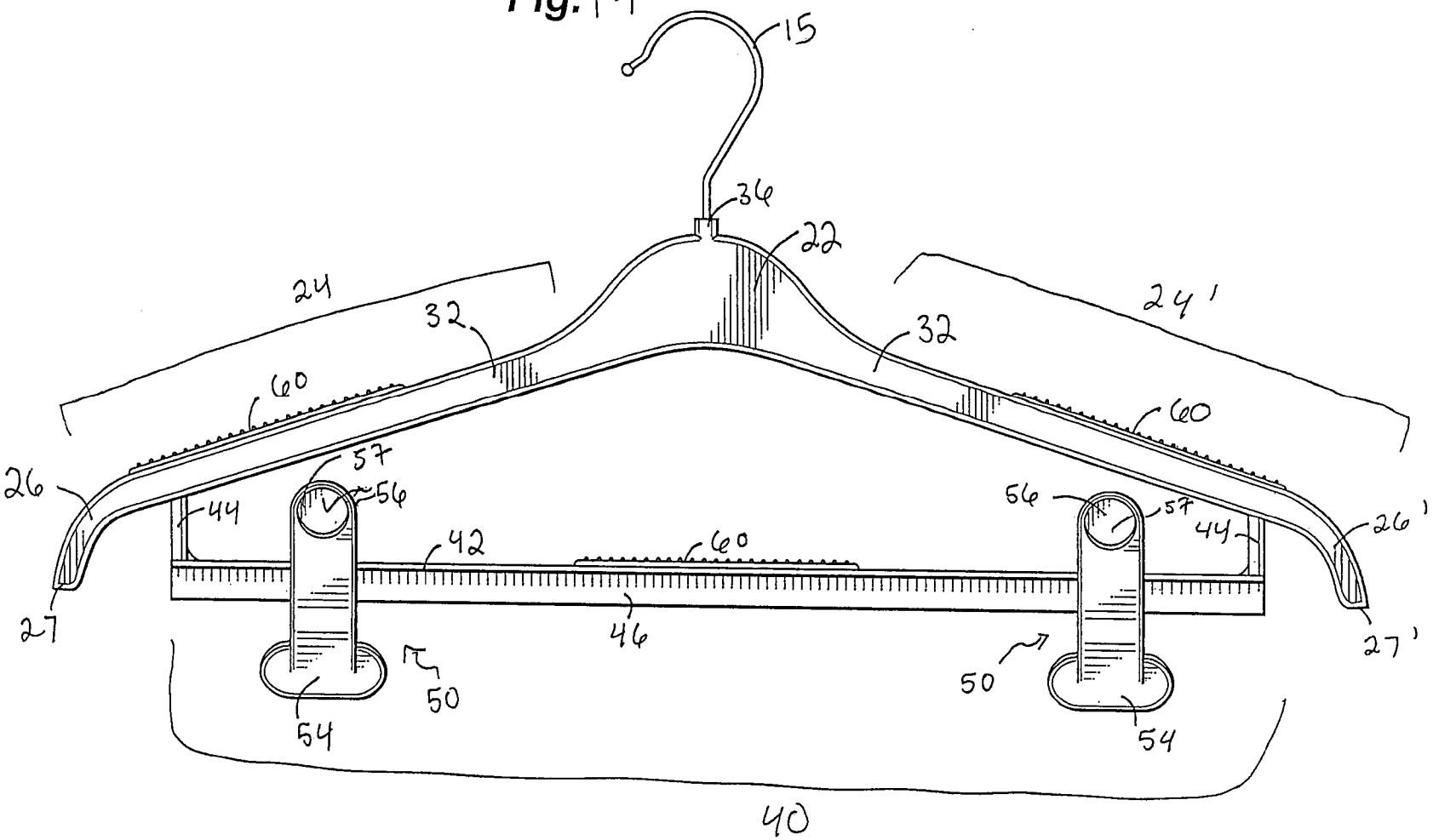
FIG. 14 is a front view of the hanger in FIG. 13.
Figure 15:
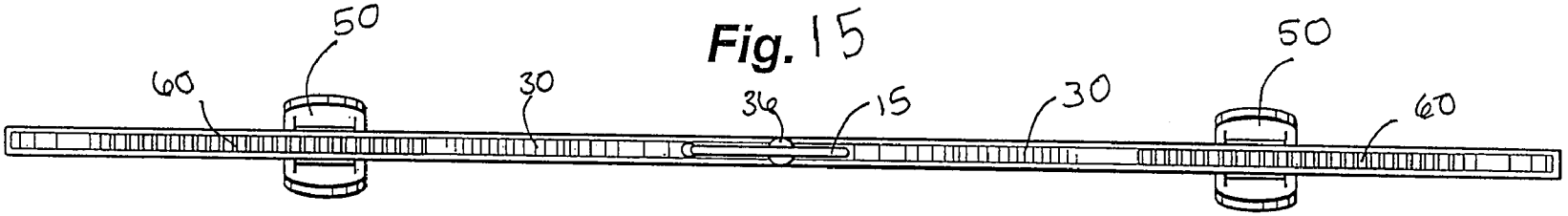
FIG. 15 is a top view of the hanger in FIG. 13.
Figure 16:
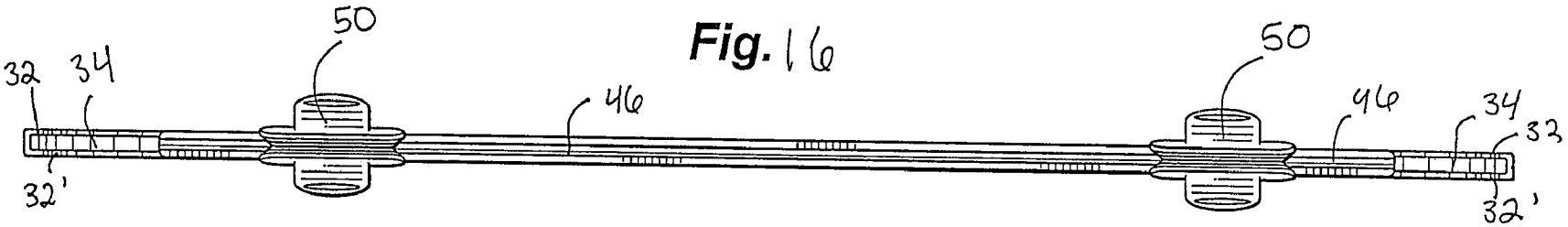
FIG. 16 is a bottom view of the hanger in FIG. 13.
Figure 17:
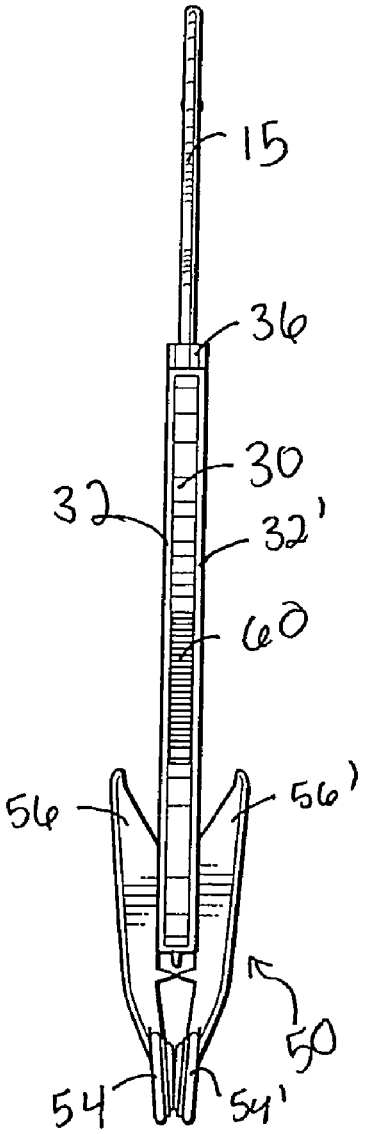
FIG. 17 is a right side view of the hanger in FIG. 13.
Figure 18:
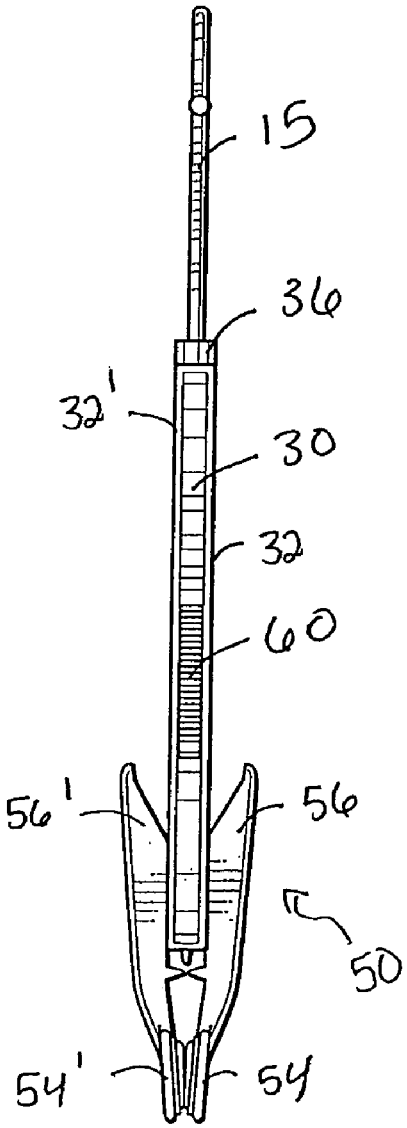
FIG. 18 is a left side view of the hanger in FIG. 13.

A third embodiment of the hanger is shown in FIGS. 13–18. This embodiment includes the elements of the second embodiment and further includes one or more clamps 50 movably positioned or disposed on the article bar 40. The clamps 50 are used for gripping suspended garments. Each clamp typically has two jaws 54, 54' opposite two handles 56, 56'. A biasing member (not shown) which is generally a U shaped metal clip is positioned between the handles 56, 56' and imparts force on the handles to bias the jaws 54, 54' together and to bias the handles 56, 56' apart. The handles 56, 56' have thumb prints 57. Preferably each thumbprint may contain a non-slip surface although it need not. Each clamp 50 may be made of the same material as the support body 20. Alternatively, it may be made from a different material from the support body 20, for example, if the support body 20 is made of a molded plastic, the clamps may be made of metal, for example.

When a garment is to be suspended using one or more clamps, one applies force to each of the handles 56, 56' to force open the jaws 54, 54'. The garment is positioned between the jaws 54, 54' and the force on the handles 56, 56' is released to grip the jaws 54, 54' about the garment. This entire operation can be carried out with one hand using the thumb and index finger. One or more non-slip surfaces 60 may also be provided along the garment contacting surfaces of the jaws 54, 54' to improve the gripping of garments. In addition, the size of the jaws 54, 54' and the non-slip surfaces 60 disperse pressure over a greater area of the garment to protect the garment from indentations or other markings which may damage the article. Grooves may also be provided on the non-slip surfaces 60 to enhance the non-slip properties of such surfaces. The position of the clamps 50 is adjustable or slidable along the length of the horizontal support bar 46.

Hangers made according to any of the embodiments, disclosed herein may range in weight from about 1 ounce to about 6 ounces. Preferably, a hanger made according to the first embodiment of the invention (having a hook and a support body) weighs about 2 ounces. A hanger made according to the second embodiment of the invention (having a hook, support body, and article bar) preferably weighs about 2.5 ounces. A hanger made according to the third embodiment of the invention (having a hook, support body, article bar, and clamps) preferably weighs about 3 ounces.

What is claimed is:

1. A hanger, comprising:

a. a support body comprising a body having a closed top, sidewalls, and an open bottom configured as a U-shaped cross-section, exterior surfaces of the sidewalls being separated at a distance of ranging from about 0.1 inches to about 0.5 inches, the body being configured as two shoulder bars joined together at a center, the two shoulder bars each having distal end regions that terminate at distal ends, wherein the support body is made of a synthetic polymer;

b. a hook coupled to the support body; and c. one or more non-slip surfaces positioned on the support body, wherein the support body can support a weight of up to about 40 pounds, wherein the hanger has a weight ranging from about 1 ounce to about 6 ounces.

2. The hanger of claim 1 wherein the exterior surfaces of the sidewalls are separated at a distance of about 0.35 inches.

3. The hanger of claim 1 wherein the hook is a metal hook.

4. The hanger of claim 1 wherein the hanger has a weight of about 2 ounces.

5. The hanger of claim 1 wherein the support body has a height ranging from about 6 inches to about 10 inches and a length ranging from about 14 inches to about 22 inches.

6. The hanger of claim 1 wherein the support body has a height of about 8.1 inches, and a length of about 18.125 inches.

7. The hanger of claim 1 wherein the support body is made of a synthetic polymer from the group consisting or polypropylene, polyethylene, polystyrene or acrylonitrile butadiene styrene.

8. The hanger of claim 1 further comprising an article bar.

9. The hanger of claim 8 wherein each end of the article bar is connected to the distal end regions of the shoulder bars by a vertical support bar.

10. The hanger of claim 9 wherein the article bar and each vertical support bar are made of the same material.

11. The hanger of claim 10 wherein the material is a synthetic polymer.

12. The hanger of claim 10 wherein the material is wood.

13. The hanger of claim 10 wherein the material is metal.

14. The hanger of claim 9 wherein the support body, article bar, and vertical support bar are fabricated as a single plastic body.

15. The hanger of claim 9 wherein the article bar and vertical support bar are formed separately from the support body.

16. The hanger of claim 8 wherein the article supporting bar comprises an article engaging surface positioned on top of a horizontal support bar.

17. The hanger of claim 16 wherein the article engaging surface is a flat surface.

18. The hanger of claim 16 wherein the article engaging surface is a curved surface.

19. The hanger of claim 9 wherein the article support bar is round.

20. The hanger of claim 16 wherein the article engaging surface is wider than the horizontal support bar.

21. The hanger of claim 16 wherein one or more non-slip surfaces are provided on the article engaging surface.

22. The hanger of claim 9 further comprising one or more clamps movably positioned upon the article bar.

23. The hanger of claim 22 wherein the one or more clamps are fabricated of the same synthetic polymer as the support body.

24. The hanger of claim 22 wherein the one or more clamps are fabricated of metal.

25. The hanger of claim 22 wherein the one or more clamps each comprise two jaws opposite two handles and a biasing member positioned between the handles for biasing the handles apart and biasing the jaws together.

26. The hanger of claim 23 wherein non-slip surfaces are provided on the two handles.

27. The hanger of claim 23 wherein non-slip surfaces are provided on the jaws.

28. A garment hanger, comprising:

a. a hook;

b. a support body comprising a body having a closed top, sidewalls, and an open bottom configured as a U-shaped cross-section, exterior surfaces of the sidewalls being separated at a distance ranging from about 0.1 inches to about 0.5 inches, the body being configured as two shoulder bars joined together at a center, the two shoulder bars each having distal end regions that terminate at distal ends, wherein the support body is made of a synthetic polymer;

c. an article supporting bar connected to the support body by vertical support bars, wherein the article supporting bar includes an article engaging surface positioned on top of a horizontal support bar;

d. one or more clamps positioned upon the article supporting bar; and e. one or more non-slip surfaces positioned upon any of the support body, article supporting bar, and one or more clamps, wherein the support body can support a weight of at least 30 pounds, wherein the hanger has a weight of about 3 ounces.

29. A hanger, comprising:

a support body adapted for suspension from a support, wherein the support body comprises a synthetic polymer and is configured as a body having a U-shaped cross section, the support body having first and second oppositely directed shoulder bars, the first and second shoulder bars being angularly downwardly directed so as to be suitable for hanging a shouldered garment thereon, the first and second shoulder bars having distal end regions that terminate at distal end regions, the first and second shoulder bars have a thickness ranging from about 0.1 inch to about 0.5 inches; and one or more non-slip surfaces disposed on the first and second shoulder bars, wherein the support body can support a weight of at least 30 pounds, wherein the hanger has a weight ranging from about 1 ounce to about 6 ounces.

30. The hanger of claim 29 wherein the distal end regions that are curved and have a radius of curvature ranging from about one inch to about three inches.

31. The hanger of claim 29 wherein the distal end regions that are curved and have a radius of curvature of about 1.7 inches.

32. The hanger of claim 29 wherein the hanger has a length defined between the distal end regions of the first and second shoulder bar wherein the length ranges from about 14 inches to about 22 inches.

33. The hanger of claim 29 further comprising an article bar extending between the first and second shoulder bars wherein the article bar has a length of ranging from about 11 inches to about 21 inches.

34. The hanger of claim 33 further comprising a clip movably disposed on the article supporting bar.

35. The hanger of claim 33 further comprising a pair of clips movably disposed on the article supporting bar.

36. The hanger of claim 29 further comprising a hook coupled to the support body for suspending the support body from a support.

37. The hanger of claim 36 wherein the hook is located where the first and second shoulder bars join together.

38. The hanger of claim 8 wherein the hanger has a weight of about 2.5 ounces.

39. The hanger of claim 22 wherein the hanger has a weight of about 3 ounces.

40. The hanger of claim 33 wherein the hanger has a weight of about 2.5 ounces.

41. The hanger of claim 35 wherein the hanger has a weight of about 3 ounces.

* * * * *